US005698049A

United States Patent [19]

Bowden

[11] Patent Number: 5,698,049

[45] Date of Patent: Dec. 16, 1997

[54] REFRACTORY ALUMINIDE/REINFORCED ALUMINUM COMPOSITE MATERIALS

[75] Inventor: David M. Bowden, St. Louis, Mo.

[73] Assignee: McDonnell Douglas Corporation, St. Louis, Mo.

[21] Appl. No.: 672,081

[22] Filed: Jun. 26, 1996

Related U.S. Application Data

[62] Division of Ser. No. 314,225, Sep. 28, 1994, Pat. No. 5,614,150.

[51] Int. Cl.[6] ..... C22C 21/00

[52] U.S. Cl. ..... 148/437; 420/528

[58] Field of Search ..... 420/590, 528, 420/552; 75/684; 148/437

[56] References Cited

U.S. PATENT DOCUMENTS 5,015,440 5/1991 Bowden ..... 419/31
5,427,735 6/1995 Ritter et al. ..... 419/47

*Primary Examiner*—Melvyn Andrews

[57] ABSTRACT

A method for producing aluminum matrix composites containing refractory aluminide whiskers or particulates which are formed in-situ is disclosed. Aluminum and refractory metal materials are blended in powder form and then heated to a temperature above the melting point of aluminum. A solid/liquid reaction between the molten aluminum and solid refractory metal provides a desired volume fraction of refractory aluminide reinforcement phase (in situ whiskers or particulates). Upon cooling the molten, unreacted portion of aluminum solidifies around the in situ reinforcements to create the improved composite material.

3 Claims, 5 Drawing Sheets

ALUMINUM-MOLYBDENUM POWDER MIXTURE

=100 X

= 450X

ALUMINUM- TANTALUM POWDER MIXTURE

= 100X

= 450X

MOLYBDENUM ALUMINIDE WISKER-REINFORCED ALUMINUM MATRIX COMPOSITE

TANTALUM ALUMINIDE PARTICULATE- REINFORCED ALUMINUM MATRIX COMPOSITE

REFRACTORY ALUMINIDE/REINFORCED ALUMINUM COMPOSITE MATERIALS

This is a division of application Ser. No. 08/314,225, filed Sep. 28, 1994 now U.S. Pat. No. 5,614,150.

BACKGROUND OF THE INVENTION

1. Field of the Invention

The present invention relates to a method for producing aluminum matrix composite materials.

2. Description of the Prior Art

There has been considerable effort over the past 10–15 years to develop aluminum-based alloys with improved specific strength and stiffness for use in advanced structural applications. One approach which has been explored is the addition of ceramic particles to produce a ceramic-reinforced metal matrix composite. Silicon carbide (SiC), in the form of whiskers or particulates, has generally been utilized as the reinforcement because of its commercial availability. Silicon carbide-reinforced aluminum matrix composites have been produced using a variety of processing methods. These methods include conventional solidification casting and powder metallurgy techniques in which the reinforcement particles and matrix alloy are blended together and subsequently consolidated together in the solid state.

One problem which limits the elevated temperature capability of silicon carbide-reinforced aluminum matrix composites is chemical interaction between the aluminum matrix and silicon carbide reinforcement. This chemical interaction takes place during composite processing and subsequent thermal exposure in service. The interaction results in chemical degradation of the reinforcement with the loss of its desirable properties and the formation of various reaction products at the reinforcement/matrix interface of the composite material. These factors influence negatively the overall mechanical properties of the composite material. To overcome these problems a variety of techniques and composite materials have been developed. The prior art illustrates these attempts to integrate a variety of matrix materials with reinforcements.

In U.S. Pat. No. 5,084,088, entitled High Temperature Alloys Synthesis By Electro-Discharge Compaction, novel materials are formed by the combined action of high pressure and high current density acting on blended powders. The process may produce a titanium alloy with TiC and $Ti_4B$ reinforcement by mixing Ti and $B_4C$ powders. Additionally this patent discloses a method to produce non-reinforced alloys from tantalum, niobium, titanium and aluminum. The non-reinforcement process is similar to shock wave consolidation, in which a high pressure shock wave is passed through a powder pack. In both processes, the energy is concentrated at the particle/particle boundaries, where it causes melting of the powders in the near-boundary regions of the powder pack. With the applied pressure, this results in densification as well as chemical interaction to form new phases. However, one drawback of this process is that the reaction products are formed only in the particle/particle boundary regions, where the melting and thus the alloying takes place. Very little change occurs at the interior region of the powder particles. Although this phenomena is identified as an advantage in the patent merely because the material appears to be homogeneous on a macroscopic scale, the material is less than adequate because it is actually quite nonuniform on a microscopic scale.

U.S. Pat. No. 4,808,373 is entitled an In-Situ Process for Producing a Composite Containing Refractory Material. The patent describes a process for producing a composite material consisting of a refractory material dispersed in a matrix of aluminum, copper and nickel, beryllium, magnesium or a ceramic material such as silicon dioxide. The refractory material is an interstitial compound, such as a carbide, boride, or nitride phase. A refractory-forming component (a reactive metal such as tantalum) is combined with a reactive component such as carbon (contained in a gas phase), to form the refractory carbide reinforcement phase. A compound such as tantalum aluminide may also be introduced to the refractory-forming component tantalum in the system. During the chemical reaction that follows, the aluminide phase undergoes chemical reduction to form a carbide phase resulting in free aluminum. In this type of process, the aluminum matrix may act as a carrier of one or both of the reactants which form the reinforcement phase, but the matrix does not take part directly in the reaction itself. In addition, the reinforcement phase formed is a carbide, rather than an aluminide. The reaction takes place between refractory-forming elements such as tantalum and reactive components such as carbon while the matrix is present merely as a carrier.

U.S. Pat. No. 5,061,323 is entitled Composition and Method For Producing an Aluminum Alloy Resistant to Environmentally-Assisted Cracking. This patent describes a process for making an aluminum alloy containing molybdenum particles. The process is entirely a solid state process and no melting takes place. The process requires extraneous processing steps of extrusion to achieve good particle bonding and optimum mechanical properties.

U.S. Pat. No. 3,926,574 ('574) is entitled Molybdenum-Based Substrate Coated with Homogeneous Molybdenum Trialuminide. This patent discloses a process of coating a molybdenum substrate by using a chemical reaction with the substrate to form the coating "in-situ". The term 'composite' used in this patent has a different meaning than used in the context of the previous patents. Here composite is taken to mean a metal substrate with a coating material rather than an integral reinforced metal matrix material. This process results in an oxidation resistant coating for molybdenum provided by the molybdenum aluminide coating, but does not improve the structural properties of either the aluminum or the molybdenum.

U.S. Pat. No. 4,402,744 entitled Chemically Bonded Aluminum Coating for Carbon Via Monocarbides, is similar to the '574 patent in that the process described results in a coating on a substrate, rather than a structural composite material.

U.S. Pat. No. 5,059,490 is entitled Metal-Ceramic Composites Containing Complex Ceramic Whiskers. The process and material are exemplary of the so-called "XD" process developed by Martin Marietta Inc. Other "XD" patents or variants thereof include U.S. Pat. Nos. 4,751,048, 4,774,052, 4,836,982, 4,915,905, 4,916,964, 4,917,964, 4,985,202, and 5,015,534. These processes require an additional melt step to introduce the intermediate material (a porous sponge) into the final matrix in order to form the reinforcement. The matrix in the XD process acts only as a solvent or host for various reactants and does not take part directly in the reaction to form the reinforcement phase. The reinforcement phase identified in aluminum matrices is never an aluminide or any other aluminum compound. Thus one cannot form an aluminide reinforcement in aluminum using the XD process.

OBJECTS OF THE INVENTION

An object of the invention is to provide a novel method for forming a refractory aluminide reinforcement phase "in-situ" in an aluminum matrix during chemical interaction of raw-material powders.

Still another object of the present invention is to provide a reinforcement phase that is thermodynamically stable with its matrix, and thus inhibit adverse reinforcement/matrix chemical interactions which tend to degrade the composite properties.

Yet another object of the present invention is to provide novel composite materials by a method which prevents reinforcement materials embedded within an aluminum matrix from dissolving or coarsening during subsequent processing operations or elevated temperature service, maintaining improved physical strength and stiffness.

An additional object is to produce the composites from readily available starting materials, in a more cost effective manner than prior methods for producing aluminum matrix composites.

The in situ method of the present invention has a particularly unexpected advantage over previous silicon carbide-reinforced aluminum composite materials, in that the need for a separate, extraneous process, outside the matrix, to produce the silicon carbide reinforcement is negated.

Therefore a principle objective of this invention is to improve the efficiency of controlling reinforcement size, shape and volume fraction.

A final object of the invention is to improve the potential for extending the useful operating temperatures of aluminum matrix composites beyond prior art capabilities.

SUMMARY OF THE INVENTION

The process of this invention involves blending together effective amounts of aluminum powder and a refractory metal powder to represent a desired volume fraction of reinforcement phase. This reinforcement phase is formed when a powder pack is placed in a niobium or other suitable can and heated under vacuum to a temperature above the melting temperature of the aluminum. This produces a chemical reaction between the molten aluminum and solid refractory metal powder that results in the in situ formation of a refractory metal aluminide reinforcement phase. After the reaction is complete and upon cooling to room temperature, the residual unreacted aluminum solidifies and envelopes the reinforcements. The solid composite material is thereafter removed from the can.

DETAILED DESCRIPTION OF THE INVENTION

In the process of this invention, a novel combined powder/metallurgical melt processing approach to the production of aluminum matrix composite materials is utilized. The term "in-situ composites" shall be employed to describe two-phase materials in which a refractory aluminide reinforcement phase is produced during processing. The term "matrix" is used to describe unreacted aluminum which, following reaction to form the reinforcement phase, is allowed to cool and solidify around the reinforcement particles.

In the first step of the process, mixtures of aluminum powder and refractory metal powder are blended together in effective amounts to produce a desired volume fraction of refractory aluminide reinforcement phase for the in situ composite. Typically, discontinuously reinforced aluminum matrix composites contain from 15–25 volume percent (and up to 36% by weight) reinforcements. The refractory material used may be, for example, niobium, molybdenum, tantalum, zirconium, tungsten or vanadium. We have produced a variety of combinations of materials which are summarized in Table 1.

Figure 1:
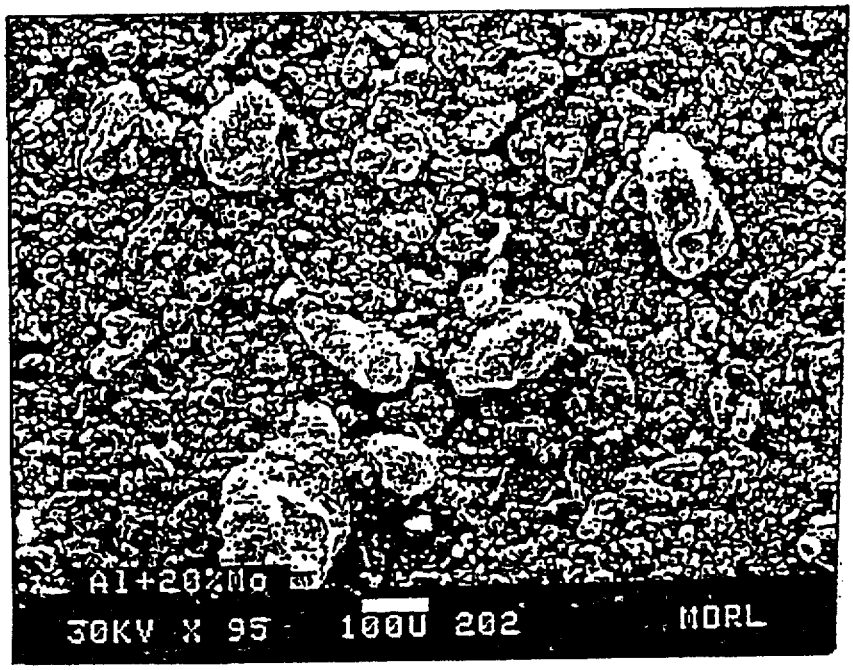
FIG. 1 shows a diagram of an aluminum-molybdenum powder mixture used to produce in situ molybdenum aluminide reinforced aluminum by the method of the present invention.
Figure 1A:
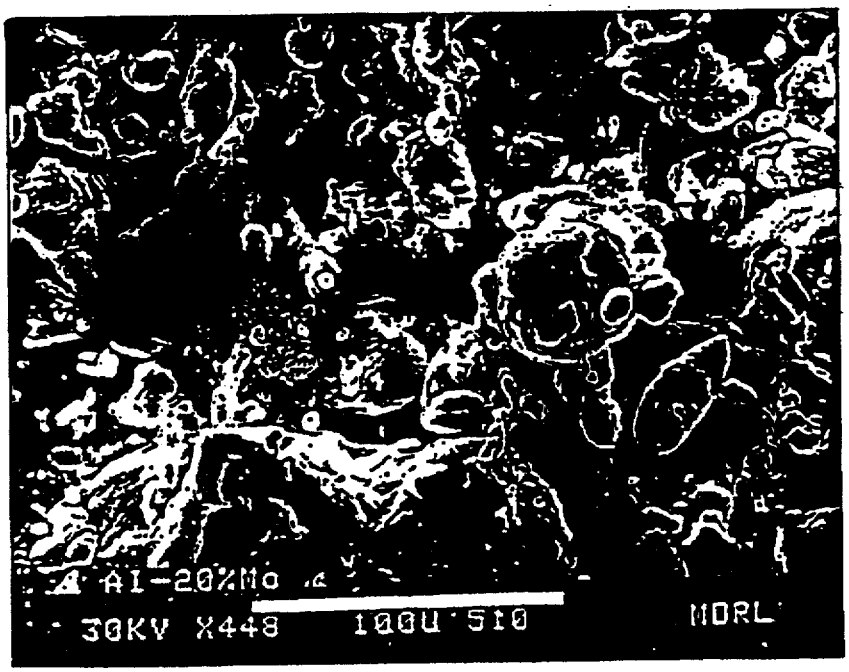
FIG. 1A shows a diagram of the aluminum-molybdenum powder mixture depicted in FIG. 1, but magnified to 450×.
Figure 2:
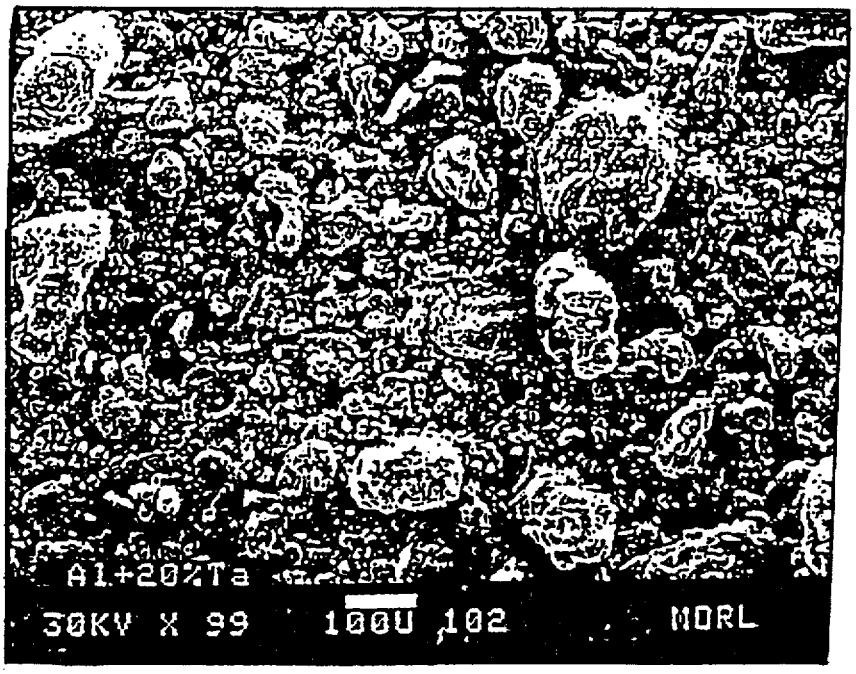
FIG. 2 shows a diagram of an aluminum-tantalum powder mixture used to produce in situ tantalum aluminide reinforced aluminum by the method of the present invention.
Figure 2A:
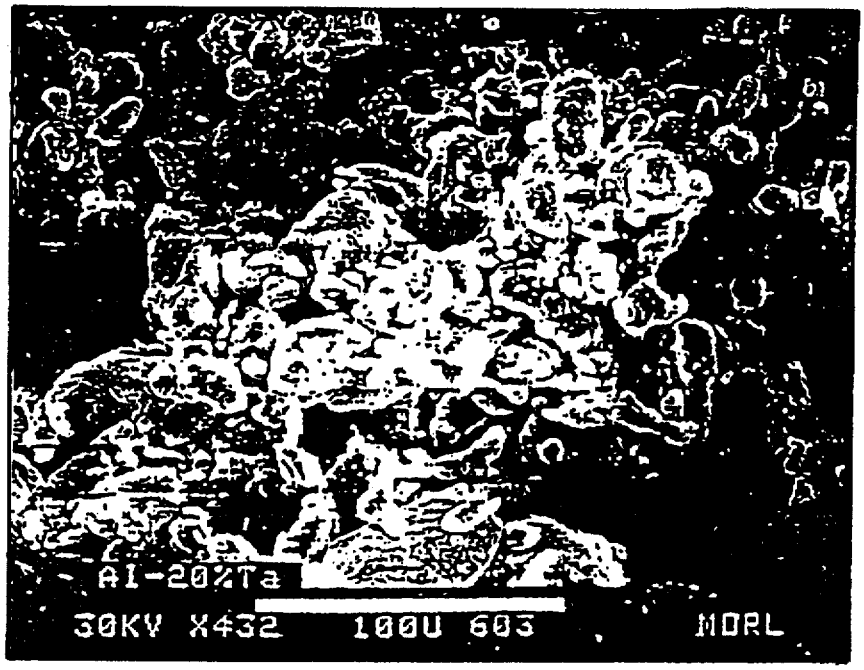
FIG. 2A shows a diagram of the aluminum-tantalum depicted in FIG. 2, but magnified to 450×.

Then, the powder blend is placed preferably in a niobium can, where the powder is heated under vacuum to drive off any absorbed moisture and gases. The characteristics of the powder used in preparing these mixtures may vary. Metal powders required to produce these composite materials are available commercially from a variety of sources, and these powders are of sufficient chemical purity to produce desirable results. These powders may be produced by a variety of processes, and may be either spherical or irregularly shaped. FIGS. 1 and 2 show mixtures of (1) aluminum and molybdenum powders, and (2) aluminum and tantalum powders used in the examples. The desired amounts of aluminum and refractory metal powder are weighed, and then mixed together sufficiently to produce a uniform mixture of powders. The method used to mix the powders is not critical to the process, and it is only required that a uniform mixture of powders result.

In the process of this invention, a vacuum of at least $1\times10^{-3}$ torr can be employed for the reaction. A temperature of at least 200° C. is used to drive off moisture and entrapped gases from the powder mixture. Moisture and gas are removed from the powder to guard against gas porosity and chemical impurities in the final composite product. Removal of moisture and gases is typically performed in the processing of aluminum powders. While some powders may require more outgassing than others, the method of outgassing is conventional. The pressure in the vacuum system rises as gases and moisture are driven off from the powder, and then decreases steadily until all gases are driven off. At this point, the can containing the reacting powders is sealed to protect powder pack from further contamination.

Niobium cans are preferred. The can withstands the processing conditions without breaking down, which would release the reactants into the reaction furnace chamber. The can must have a high melting point, well beyond the melting point of aluminum, so that it does not melt during processing. Also, it must not react with the contents of the can to the extent that the composite product is contaminated. While niobium does react with molten aluminum, the can wall thickness should be sufficient that reaction does not progress all the way through the can wall. Other can materials could be used, as long as they satisfy the requirements, but niobium is a preferred can material.

The powder pack sealing can be achieved by welding in a vacuum environment. The welding is performed preferably in a vacuum of at least $1\times10^{-3}$ torr, since niobium must be welded in vacuum. The can is sealed to ensure that the powder mixture is protected from contamination.

The sealed powder pack is then placed in a vacuum furnace and heated to a temperature above the 660° C. melting point of aluminum. The vacuum furnace serves to prevent rapid oxidation of the niobium can.

The chemical reaction between the molten aluminum and solid refractory metal powder results in the in situ formation of a refractory metal aluminide reinforcement phase.

The fact that solid refractory metal powder will react with molten aluminum to form a refractory aluminide phase with a variety of novel characteristics, within a composite, and will do so quite rapidly, is unexpected. Although U.S. Pat. No. 5,015,440 utilizes mixtures of aluminum and refractory powders to form refractory aluminide materials, solid pieces of refractory aluminide were formed, not aluminum matrix composites containing refractory reinforcements. Among the most unexpectedly beneficial results is the fact that different refractory metal additions produced different shapes of refractory aluminide reinforcements. For example, niobium and tantalum additions produce equiaxed, or regularly shaped particulates, while molybdenum additions form needles, or whisker shapes. The scientific reasons for this are not completely understood. The fact that different shapes are formed is especially unexpected because the refractory metals all have similar crystal structures. The ability to control not only the volume fraction of reinforcement phase (by how much refractory metal is added to the mixture), but the size (by refractory metal powder particle size) and shape of the reinforcement phase (by selection of the appropriate refractory metal addition) are particularly beneficial advantages of our process and materials. The ability to produce different shapes of reinforcements with the same process depending on the addition used, is a particularly novel discovery because the same essential process can be used to produce composite materials with different characteristics. Chemical compatibility between reinforcement and matrix, and clean reinforcement/matrix interfaces, are also advantageous. Chemical reactions between the matrix and reinforcing particulates, which cause degradation of the reinforcement and formation of brittle reaction products at the fiber/matrix interface, are avoided entirely since the reinforcement is itself a reaction product. In addition, the reinforcement cannot dissolve into the matrix or coarsen during elevated temperature service, due to the low solubility of the refractory metals in aluminum. Thus, these reinforcements are not only thermodynamically stable (meaning they will not react with the matrix) but they are also morphologically stable (meaning they have a stable size and shape). Both of these factors will allow the composite to maintain properties in service.

Figure 3:
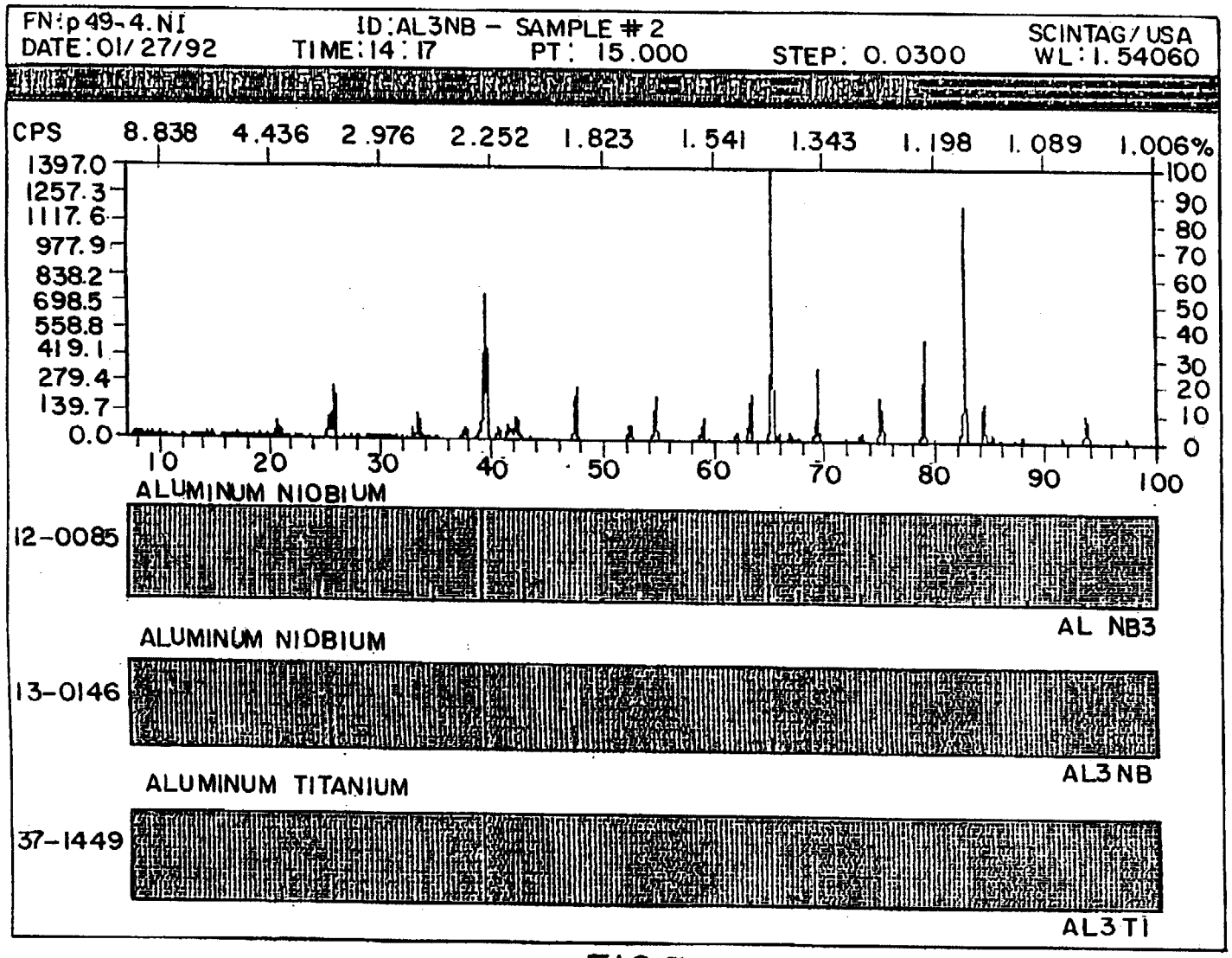
FIG. 3 is a chart of an x-ray diffraction analysis of the niobium aluminide particulate-reinforcement in a niobium aluminide-reinforced aluminum matrix composite produced by the method of the present invention.
Figure 4:
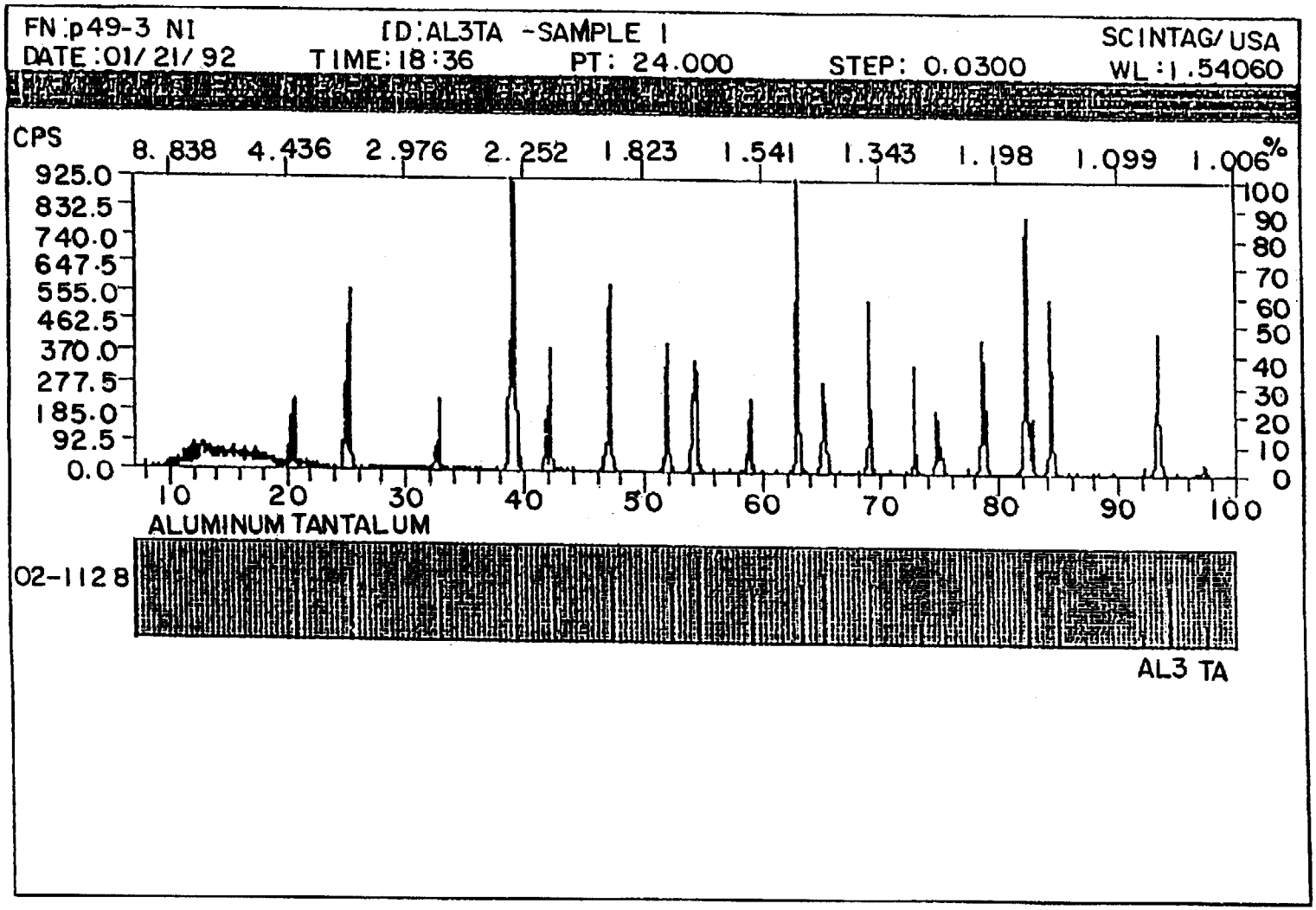
FIG. 4 is a chart of an x-ray diffraction analysis of the tantalum aluminide particulate-reinforcement in a tantalum aluminide-reinforced aluminum matrix composite produced by the method of the present invention.

X-ray analysis shows that the phases formed are $Al_3Nb$ (in the aluminum-niobium system) (FIG. 3), $Al_3Ta$ (in the aluminum-tantalum system) (FIG. 4), and approximately $Al_8Mo_3$ in the aluminum-molybdenum system.

Sufficient time (for example, is 2 to 4 hours at 800° to 1200° C.) at the maximum temperature is required for the reaction to proceed to completion, and this will depend to some extent on the refractory metal particle size utilized and the temperature utilized for the reaction. Higher temperatures will require shorter reaction times for a given refractory metal particle size.

Upon completion of the reaction, the powder pack is cooled to room temperature which allows the aluminum matrix to solidify around the refractory aluminide reinforcement particles, resulting in an aluminum matrix composite material. The niobium can is subsequently machined or chemically milled off of the composite. The remaining composite material can be further processed by extrusion or other conventional metalworking operations, as desired. Secondary processing steps may be desired, for example, to seal any porosity existing in the final composite or to further improve the uniformity of the microstructure in the final composite.

Figure 5:
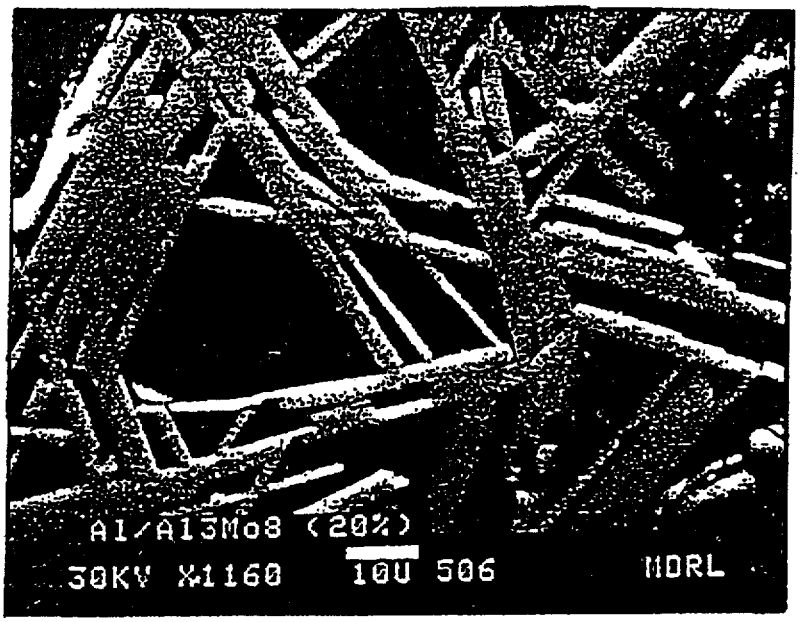
FIG. 5 is a diagram of a molybdenum aluminide whisker-reinforced aluminum matrix composite produced by the method of the present invention.
Figure 6:
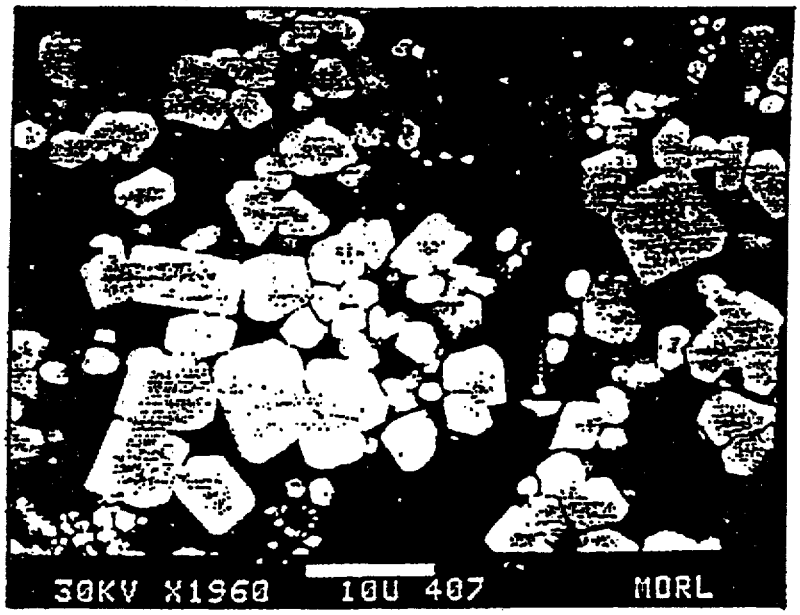
FIG. 6 is a diagram of a tantalum aluminide particulate-reinforced aluminum matrix composite produced by the method of the present invention.

Examples of reacted composite materials are shown in FIGS. 5 and 6. In FIG. 5, the whisker-like molybdenum aluminide reaction product is illustrated, and in FIG. 6, the more equiaxed tantalum aluminide reaction product is shown.

Aluminum matrix composites having reinforcement phases comprising roughly 15 to 30 percent by volume of the overall composite were formed from raw material mixtures in Table 1.

TABLE 1

| Chemical System | Wt. % Aluminum Powder | Wt. % Refractory Metal Powder | Volume % Reinforcement |
|---|---|---|---|
| Aluminum-Niobium | | | |
| 15% reacted | 85 | 15 | 18 |
| 20% reacted | 81 | 19 | 24 |
| 25% reacted | 78 | 22 | 30 |
| Aluminum-Molybdenum | | | |
| 15% reacted | 85 | 15 | 19 |
| 20% reacted | 81 | 19 | 25 |
| 25% reacted | 77 | 23 | 31 |
| Aluminum-Tantalum | | | |
| 15% reacted | 75 | 25 | 20 |
| 20% reacted | 69 | 31 | 26 |
| 25% reacted | 64 | 36 | 32 |

What is claimed is:

1. A thermodynamically and morphologically stable two-phase composite material comprising a. from about 15 to about 30 volume percent of a refractory aluminide reinforcement phase, said phase being selected from the group of aluminides consisting of titanium, zirconium, vanadium, niobium, tantalum, molybdenum and tungsten aluminides; and b. from 85 to 70 volume percent of an aluminum matrix solidified around said refractory aluminide reinforcements.

2. The composite material of claim 1 wherein the refractory aluminide phase is molybdenum aluminide and has a whisker-like shape.

3. The composite material of claim 1 wherein the refractory aluminide phase is tantalum aluminide and has an equiaxed shape.

* * * * *